US007104494B2

(12) United States Patent
Casella et al.

(10) Patent No.: US 7,104,494 B2
(45) Date of Patent: Sep. 12, 2006

(54) LOG DISCHARGE DEVICE FOR A REWINDING MACHINE

(75) Inventors: Sergio Casella, Fornoli Bagni di Lucca (IT); Mauro Biagioni, Pietro a Vico (IT)

(73) Assignee: Paper Converting Machine Company, Green Bay, WI (US)

( * ) Notice: Subject to any disclaimer, the term of this patent is extended or adjusted under 35 U.S.C. 154(b) by 33 days.

(21) Appl. No.: 10/897,824

(22) Filed: Jul. 22, 2004

(65) Prior Publication Data

US 2005/0092867 A1 May 5, 2005

(30) Foreign Application Priority Data

Oct. 17, 2003 (IT) ..... MI20030485 U

(51) Int. Cl.
*B65H 19/22* (2006.01)

(52) U.S. Cl. ..... 242/533; 242/542

(58) Field of Classification Search ..... 242/542.2, 242/520, 533, 542, 542.3
See application file for complete search history.

(56) References Cited

U.S. PATENT DOCUMENTS

| | | | | |
|---|---|---|---|---|
| 4,277,032 | A | 7/1981 | Alberto et al. | 242/66 |
| 4,327,877 | A * | 5/1982 | Perini | 242/521 |
| 5,137,225 | A * | 8/1992 | Biagiotti | 242/521 |
| 5,242,525 | A * | 9/1993 | Biagiotti | 156/357 |
| 5,368,252 | A * | 11/1994 | Biagiotti | 242/521 |
| 5,643,398 | A * | 7/1997 | Lumberg | 156/446 |
| 5,772,149 | A * | 6/1998 | Butterworth | 242/533.2 |
| 5,820,064 | A * | 10/1998 | Butterworth | 242/533.2 |
| 6,000,657 | A * | 12/1999 | Butterworth | 242/533.2 |
| 6,056,229 | A * | 5/2000 | Blume et al. | 242/521 |
| 6,398,146 | B1 * | 6/2002 | Cattaneo | 242/379.2 |
| 6,497,383 | B1 * | 12/2002 | Daul et al. | 242/521 |
| 6,877,689 | B1 * | 4/2005 | Butterworth | 242/542.1 |
| 2004/0178295 | A1 * | 9/2004 | Betti et al. | 242/533 |
| 2004/0256513 | A1 * | 12/2004 | Perini | 242/521 |
| 2005/0092863 | A1 * | 5/2005 | Fabio | 242/533 |

FOREIGN PATENT DOCUMENTS

EP 0 481 929 A1 4/1992

* cited by examiner

*Primary Examiner*—John Q. Nguyen
*Assistant Examiner*—William E. Dondero
(74) *Attorney, Agent, or Firm*—Greer, Burns & Crain, Ltd.

(57) ABSTRACT

In a rewinding machine (10), a device (50) for discharging logs (20, 20') comprises: a chute (30) disposed downstream of a winding area (2) designed to allow the formed logs (20') to roll towards the output of the winding machine (10), a stopping device (111, 117) designed to stop the log (20') on the chute (30), and an actuator (113) acting on the stopping device (111) to bring it from a working position in which it stops the log (20') to a resting position in which it allows the log (20') to roll on the chute (30). The chute (30) comprises: a first portion (31) with a slight slope, disposed at the output of the winding area (2), designed to slow the log (20') by friction or in any case not to accelerate the rolling thereof, and a second portion (32) with a slope greater than that of the first portion (31), designed to accelerate by gravity the rolling of the log (20') after it has been stopped by means of the stopping device (111,117).

17 Claims, 6 Drawing Sheets

LOG DISCHARGE DEVICE FOR A REWINDING MACHINE

The present invention refers to a log discharge device for a rewinding machine.

In a peripheral rewinding machine of the type to which the invention refers, a log or roll is formed by winding a web around a tubular core which is set in rotation between a set of three rollers which act on the periphery of the log being formed, The speeds of the rollers are kept constant and equal during the winding cycle.

The set of three motorised rollers forms a space of variable size so that the three rollers are always in contact with the log being formed as it grows in diameter. Two of the three rollers are usually placed at a set distance, so as to define a gap through which a core is inserted and in which the sheet material travels, whilst the third roller or pressure roller is movable and allows the log to increase in diameter and to be expelled thereof at the end of winding.

In these rewinding machines the so-called changeover stage is important, i.e. the insertion in the winding space of a new core accompanied by a special inserter and the discharge of the completed log after severing of the web material.

FIG. 1 diagrammatically illustrates a rewinding machine denoted by 10 which has a log discharge device according to the prior art, denoted with reference numeral 100.

The rewinding machine 10 comprises three winding rollers 1*a*, 1*b* and 1*c* which define a cradle 2 into which a cardboard core 3, on which web material 4 is wound to form a log 20, is fed. A roller 1*c* of the set of three rollers is mounted on an arm 5 pivoted at 6 to the side of the machine to follow the growing in diameter of the log 20 being formed in the cradle 2.

The log discharge device 100 comprises an inclined chute 130 and an arm 111 disposed above the chute 130 and pivoted at a pivot point F to the side of the machine. The arm 111 is brought into rotation around the pivot F by a linear actuator 113. The actuator 113 comprises a pneumatic cylinder 114 pivoted at 116 to the side of the machine and a piston 115 slidable inside the cylinder 114. The free end of the piston 115 is connected to the arm 111.

On the surface of the arm 111 facing the chute 130 there is fixed a thin curved sheet of rubber 117 serving to cushion a formed log 20' expelled by the winding rollers 1*a*, 1*b*, 1*c* of the rewinding machine 10.

The plane t tangent the curved rubber sheet 117 at the point C of contact with the log 20' forms with the chute 130 a V-shaped narrowing in which the log 20' expelled by the winding rollers 1*a*, 1*b* and 1*c* comes to rest.

It must be considered that the tangent plane t is substantially parallel to the longitudinal axis b of the arm 111 passing through its pivot F. In this case an angle θ depending upon the slope of the chute 130 with respect to a horizontal plane is formed between the axis b of the arm 111 and the plane of the chute 130, said angle θ being less than 45°, equal to about 30°.

Operation of the rewinding machine 10 is described below.

The log 20 is formed by winding of a paper tissue 4 on a cardboard core 3. The log 20 is brought into rotation by contact with the three winding rollers (1*a*, 1*b*, 1*c*), one of which (1*c*) is movable to define and to follow the growing in diameter of the log 20 being formed.

Once the required diameter of the log 20' has been reached, the log 20' is expelled from the winding area 2 toward the machine discharge by the three winding rollers (1*a*, 1*b*, 1*c*) through creation of a peripheral speed difference among said rollers.

The log 20' is expelled at high speed onto the inclined chute 130, and it is necessary to slow its speed before discharging it to the next stage of production, performed by a gluing device or a gluing machine (not shown) disposed downstream of the discharge chute 130. The log 20' is stopped by the movable arm 111 on which the rubber 117 (or other materials able to cushion the inertia of the log) serving to cushion the impact between the log 20' and the arm 111 and to not damage the surface of said log is attached.

The raising of the movable arm 111 by means of the actuator 113 allows the log 20' to leave the chute 130 under the action of the component of the gravity acceleration which is parallel to the chute 130.

This solution according to the prior art presents various disadvantages and drawbacks. The rewinding machine 10 can produce as many as 60 logs/mm; therefore, the expulsion speed of the logs is high, whereas the time available for stopping the log and removing it from the chute 130 is bound by various factors, as will be described below.

The log discharge times of the current solution do not allow a rate of more than 35–40 logs/min because:

a) the slope of the chute 130 does not ensure an acceleration enough to a rapid removal of the log (the slope of the chute is bound by the expulsion trajectory of the log from the winding rollers, so as to ensure the log to be supported and to avoid jolting or impact on the chute; the slope of the expulsion trajectory cannot be significantly increased by changing the position of the winding rollers, position which is bound by the unstable contact of the movable roller 1*c* on the log 20: consequently, the two fixed winding rollers 1*a* and 1*b* must be positioned so as to support the weight of the log 20 during winding);

b) after stopping, the log 20' can leave the chute 130 only after the arm 111 has been raised by such an angle to allow the log to pass (said angle varies with the diameter of the log and becomes considerable for large diameter logs).

Therefore, the log discharge is currently the main constraint on the production of the winding machine 10.

The object of the present invention is to eliminate the drawbacks of the prior art by providing a log discharge device for a rewinding machine that is efficient, effective and that allows the log production and expulsion speed to be increased as much as possible.

Another object of the present invention is to provide a log discharge device that is extremely reliable and able not to damage the paper tissue wound on the log.

Another object of the present invention is to provide a log discharge device that is versatile, suitable to be applied to various types of rewinding machines and, at the same time, inexpensive and easy to produce.

These objects are achieved in accordance with the invention with the characteristics listed in the appended independent claim 1.

Advantageous embodiments of the invention are apparent from the dependent claims. The log discharge device according to the invention comprises:

- a chute disposed downstream of a winding area of a rewinding machine able to allow the rolling of the formed logs towards the winding machine discharge,
- stopping means able to stop or to slow the log on said chute, and
- drive means acting on said stopping means to bring them from a working position in which they stop the log on said chute to a resting position in which they allow the rolling of the log on said chute.

The main feature of the invention is represented by the fact that the chute comprises:

a first portion with a slight slope, disposed at the output of said winding area, designed to slow the log by friction or in any case not to accelerate the log leaving the winding area, and a second portion with a slope greater than that of the first portion, designed to accelerate the log by gravity after it has been stopped by the stopping means. In this manner, the removal times are reduced, allowing rapid positioning of the stopping means ready to receive a new log.

The new shape of the chute with more than one slope allows the stopping arm to be positioned so as to obtain the space for the passage of the stopped log with a small rotation of the arm. The total removal times are reduced because of the rapid positioning of the stopping means ready to receive a new log.

Further characteristics of the invention will be made clearer by the detailed description that follows, referring to a purely exemplary and therefore non limiting embodiment thereof, illustrated in the appended drawings, in which.

Figure 1:
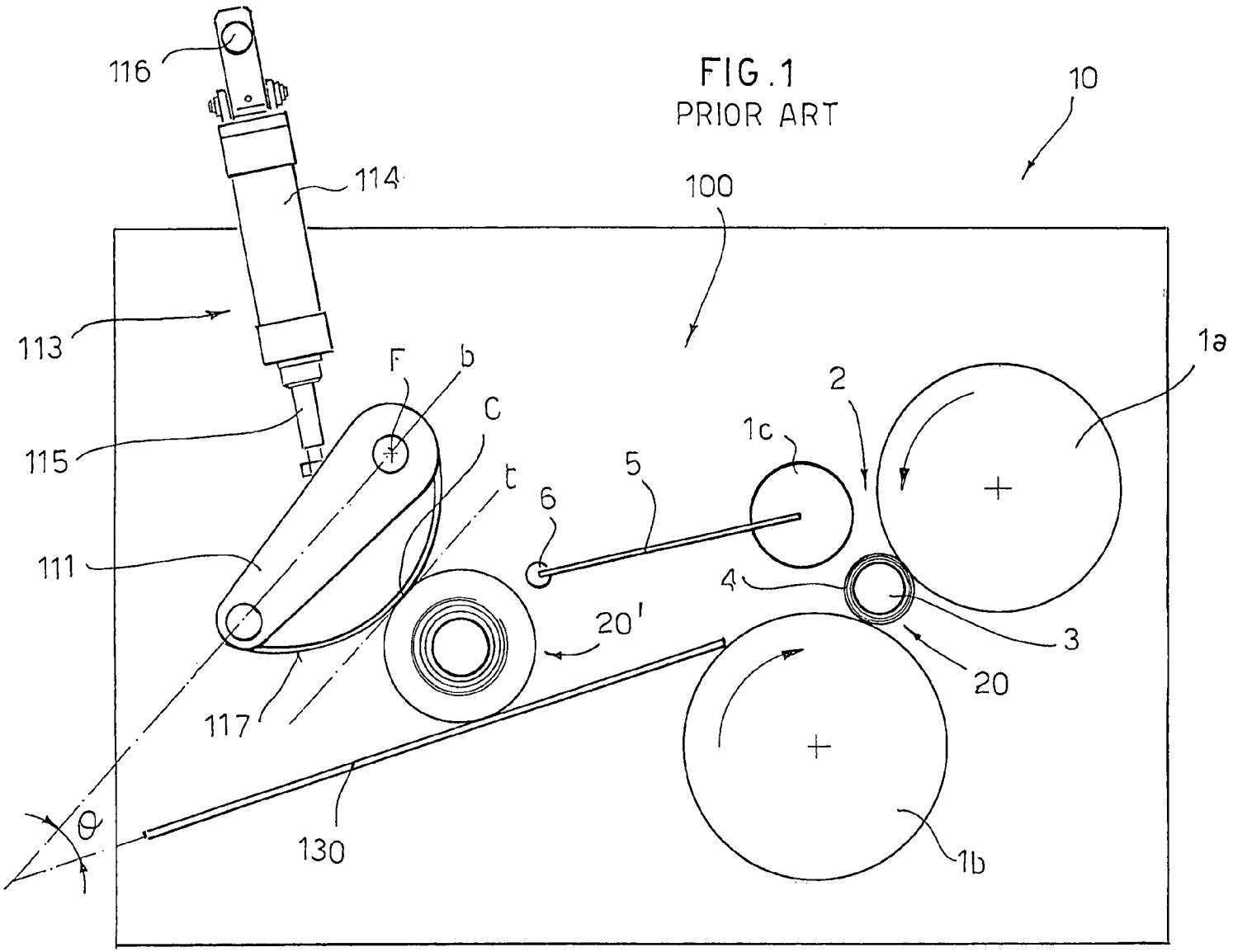
FIG. 1 PRIOR ART
FIG. 1 is a diagrammatic side elevational view of a log discharge device according to the prior art.
Figure 2:
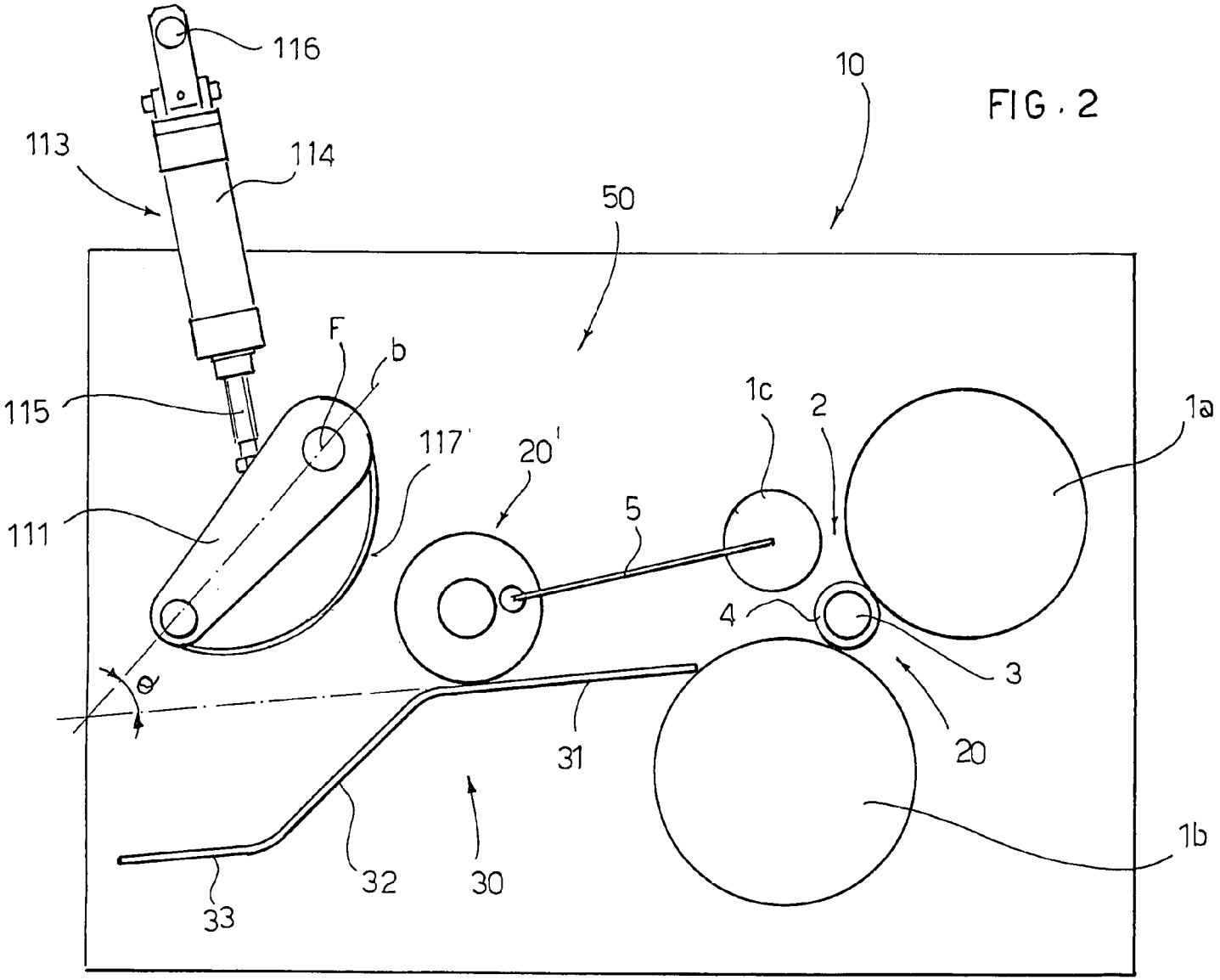
FIGS. 2, 3 and 4 are diagrammatic side elevational views of a log discharge device according to the invention, shown in three successive stages of expulsion of the log from the rewinding machine.
Figure 5:
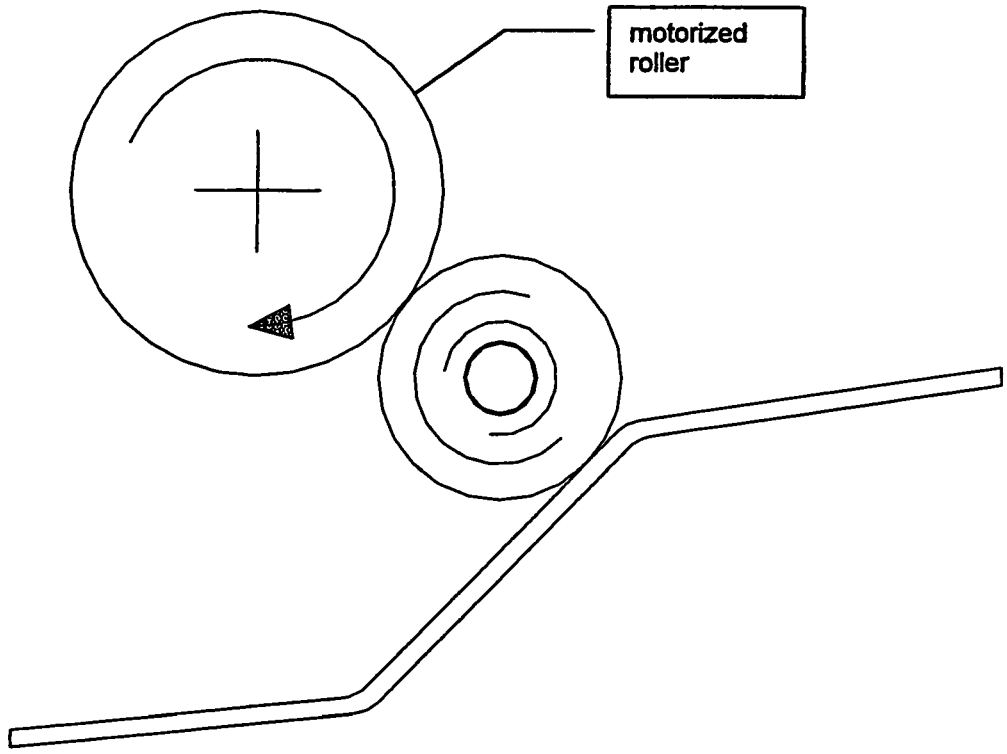
Figure 6:
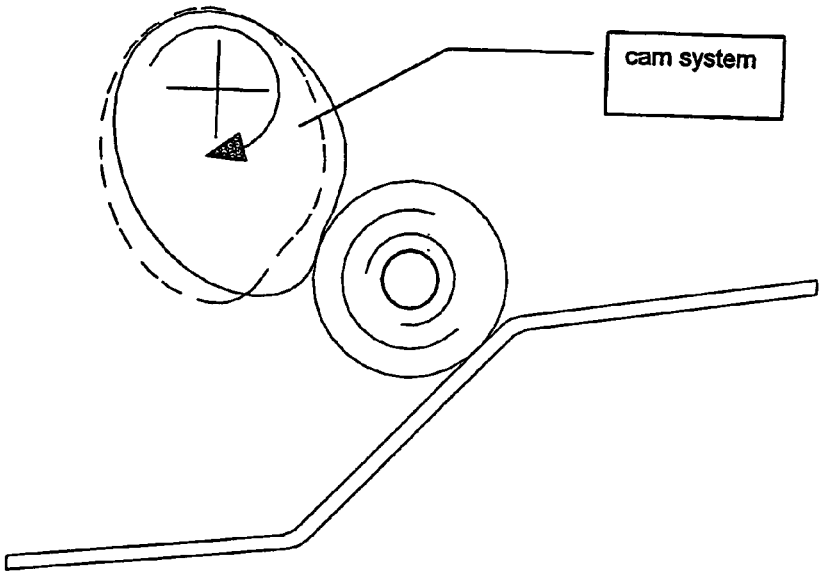
Figure 7:
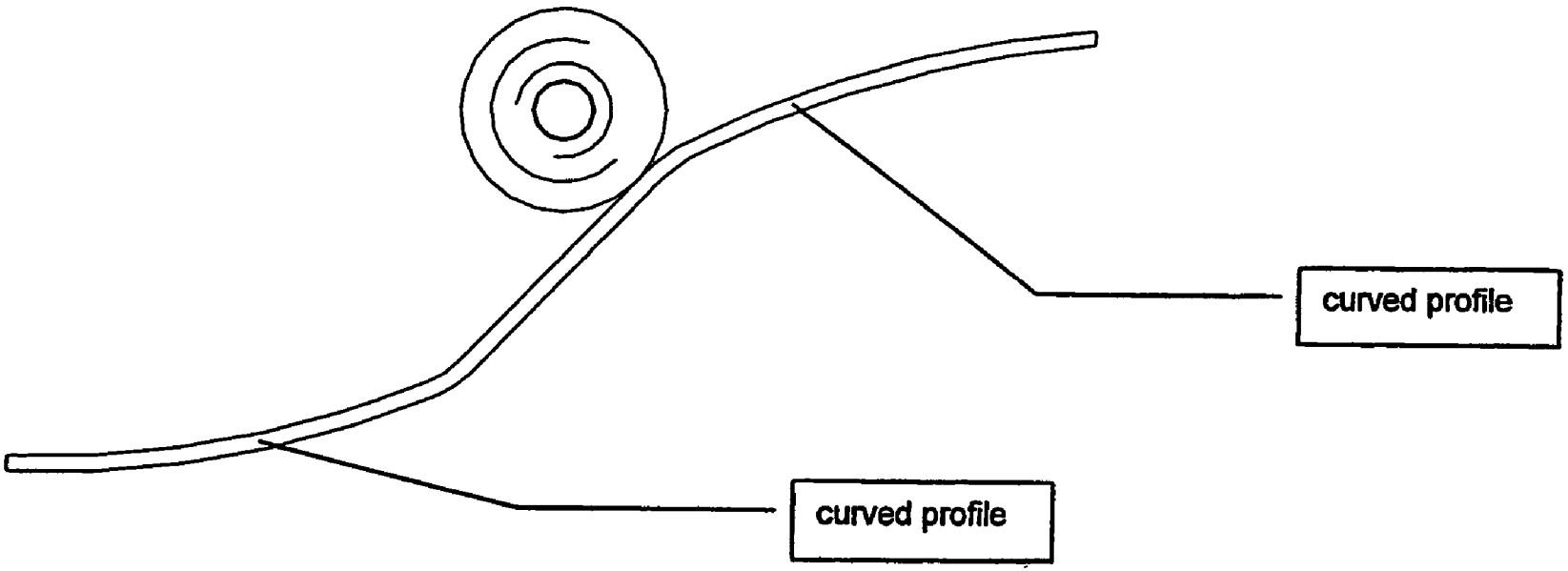

FIGS. 5, 6, and 7 are views similar to FIG. 2 which show alternative embodiments of the invention.

Figure 3:
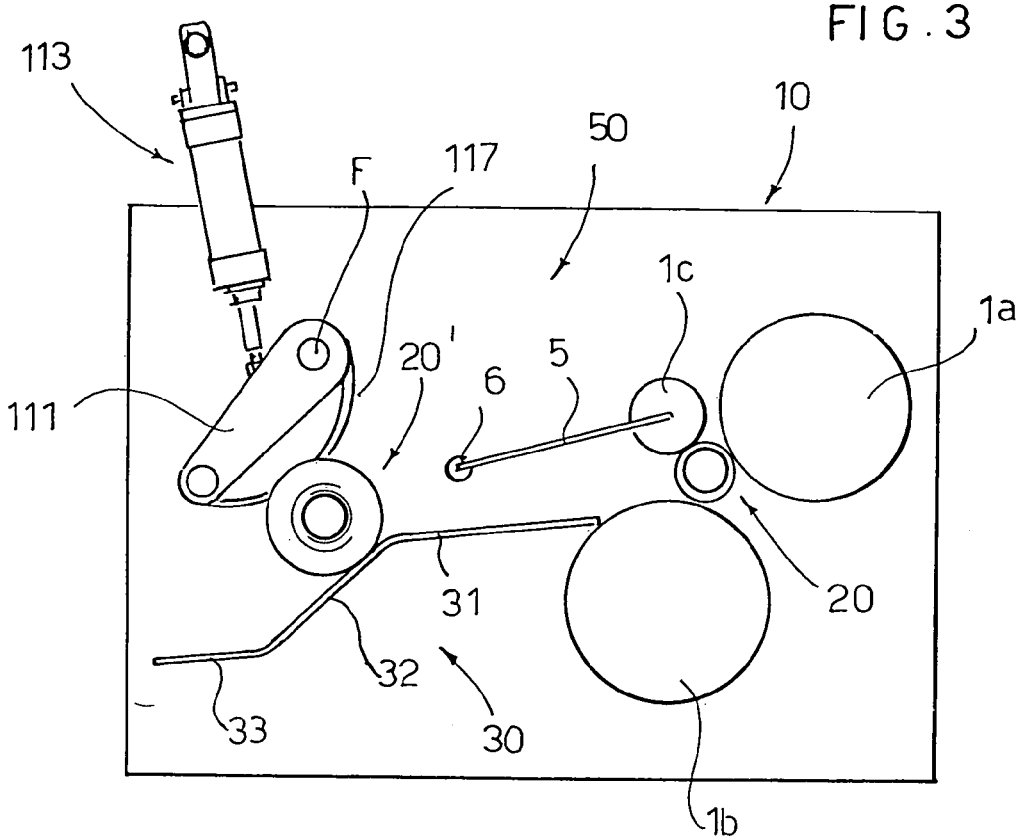
Figure 4:
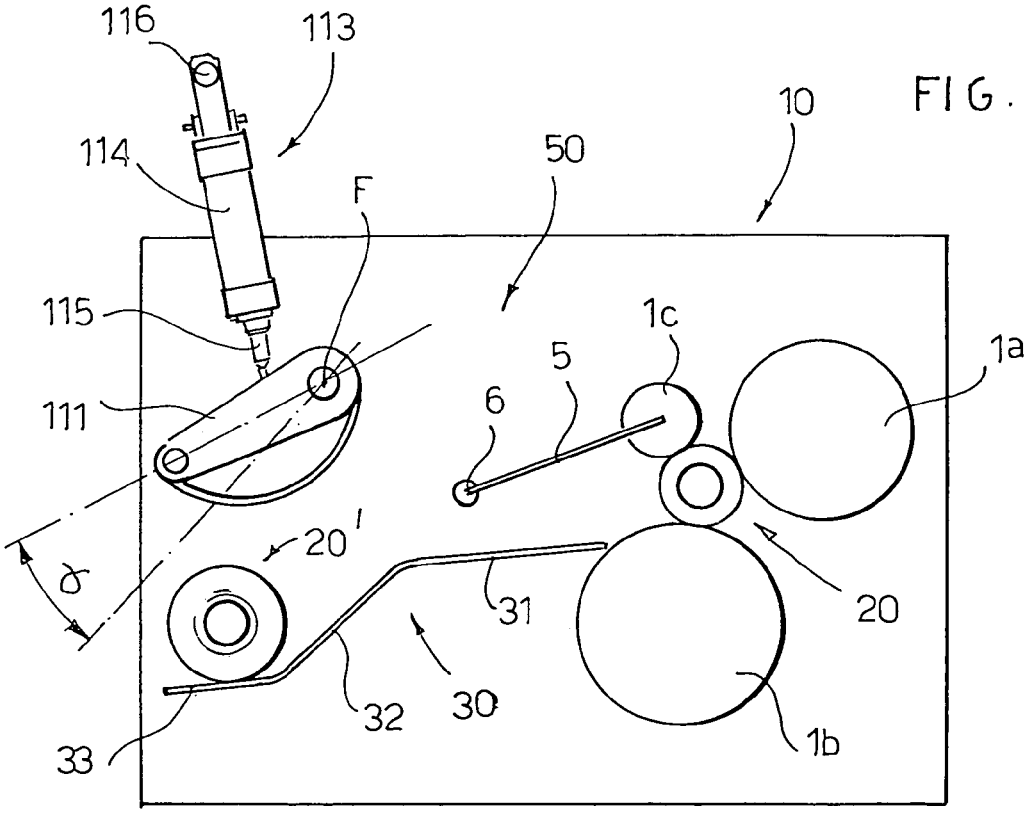

The log discharge device according to the invention, denoted as a whole with reference numeral 50, is described with the aid of FIGS. 2–4.

Elements equal or corresponding to those already described are indicated hereunder with the same reference numerals and are not described in detail.

As shown in FIGS. 2–4, the log discharge device 50 comprises a chute 30 with a new shape with respect to the prior art. In fact the chute 30 has three portions with different slopes: a first input portion 31, a second intermediate portion 32 and a third discharge portion 33.

The input portion 31 is disposed at the output of the winding cradle 2, and is slightly inclined with respect to a horizontal plane. The input portion 31 can have, for example, an angle of inclination with respect to the horizontal plane in a range from 5° to 20°.

The intermediate portion 32 has a slope greater than that of the input portion 31. The intermediate portion 32 can have, for example, an angle of inclination with respect to the horizontal plane in a range from 30° to 60°.

The discharge portion 33 has a slope smaller than that of the intermediate portion 32 and substantially equal to the slope of the input portion 31. The discharge portion 33 can have, for example, an angle of inclination with respect to the horizontal plane in a range from 5° to 20°.

As in the prior art, the log discharge device 50 comprises a pivoted arm 111 brought into rotation by a pneumatic cylinder 113. A thin sheet or a pad of rubber (or of other suitable soft material) 117 serving to cushion the log is fixed on the arm 111.

In this case the arm 111 is positioned so as to increase, with respect to the prior art, the angle θ between the axis b of the arm 111 and the plane of the input portion 31 of the chute 30 which corresponds to the angle of the V-shaped narrowing in which the log stops. In this case the angle θ is greater than 30° and is about 45°. Furthermore said angle θ is chosen so that the plane passing through the axis b of the arm 111 is substantially parallel to the plane of the intermediate portion 32 of the chute.

Furthermore the arrangement of the arm 111 is such that the log is blocked by the rubber sheet or pad 117 at the end of the first portion 31 of the chute and at the beginning of the intermediate portion 32 of the chute (FIG. 3).

The movable arm 111 can be replaced by other systems, such as a motorised roller or a series of cams with a suitable profile which allow the log to be stopped and to be removed upon a rotation at a controlled speed (brought by the speed of winding and by the diameter of the log).

The linear actuator 113 can be replaced by other transmission means, such as motorised cams, connecting rod-crank kinematic mechanisms, etc.

Operation of the discharge device 50 according to the invention is described hereunder.

With reference to FIG. 2, a formed log 20' with the desired diameter is expelled from the winding area 2 towards the machine discharge by the three winding rollers (1*a*, 1*b*, 1*c*) by creation of a peripheral speed difference among said rollers. A new core 3 is inserted in the winding cradle 2 and a web 4 begins to be wound around said core to form a new log 20.

The formed log 20' is expelled at a high speed from the winding cradle 2 onto the inclined chute 30. Thus, it is necessary to slow the speed of the log 20' before passing it to the subsequent production step, performed by a gluing device or by a gluing machine (not shown) disposed downstream of the discharge chute 30.

The log 20' is first slowed by friction, or in any case not accelerated, by the input portion 31 of the chute, which has a slight slope. Subsequently, as shown in FIG. 3, when the log 20' reaches the end of the input portion 31 and the beginning of the intermediate portion 32 of the chute, it is stopped or further slowed by the movable arm 111 on which is fixed the rubber sheet or pad 117 which acts as a shock absorber.

As shown in FIG. 4, a small rotation of the moveable arm 111 around its own pivot F, obtained by the return of the piston 115 into the cylinder 114 of the actuator 113, allows the log 20' to roll along the intermediate portion 32 of the chute 30 under the action of the component of the gravity acceleration which is parallel to the intermediate portion 32 of the chute 30. In this case the arm 111 must rotate through a fairly small angle α, which can be between 10° and 20°.

The log 20' then undergoes a sharp gravity acceleration along the portion 32 with a greater slope and subsequently its rolling speed is slowed in the last portion 33 of the chute 30 which has a slope smaller than that of the intermediate portion 32.

Said log discharge device according to the invention has various advantages.

The log discharge times are reduced, allowing a removal rate of 60 logs/min to be achieved.

In fact the first portion 31 of the chute with a smaller slope ensures that the log 20' is supported and slowed during the expulsion step by the winding rollers (1*a*, 1*b*, 1*c*) or in any case it does not allow an acceleration of the log.

The log 20' stops between the arm 111 and the chute 30 near the beginning of the portion of the chute 32 with a greater slope. The portion of the chute 32 with a greater slope ensures a greater acceleration component for the log 20' when the arm 111 is moved, thus allowing a rapid removal.

The rapid removal of the log 20' allows the arm 111 to be positioned in a very short time ready to receive a new log.

Furthermore, the position of the arm 111 during the stopping of the log 20' is adjustable according to the diameter of the log 20'. This, together with the greater slope of the portion of the chute 32, makes it possible that a minimum rotation angle—of aperture α—of the arm 111 be sufficient for discharging the log 20'.

Although specific reference has been made in the foregoing description to a chute with three portions, it is clear that the number thereof can be different, two or more, provided that there is a rapid increase in the slope downstream of the log stopping or slowing means, to allow a rapid removal of the log.

Furthermore, the different portions of the chute are preferably linear but (at least some of them) could also have a curved profile.

Numerous variations and modifications of detail within the reach of a person skilled in the art can be made to the present embodiment of the invention without thereby departing from the scope of the invention, as set forth in the appended claims.

The invention claimed is:

1. A device for discharging logs from a rewinding machine comprising:

a chute disposed downstream of a winding area of said rewinding machine and able to allow formed logs to roll towards the output of the rewinding machine stopping means able to stop or to slow the log on said chute, and drive means acting on said stopping means to bring them from a working position in which they stop or slow the log on said chute to a resting position in which they allow the log to roll freely on said chute, characterized in that said chute comprises:

at least a first portion with a slight slope, disposed at the output of said winding area, and a second portion downstream from said first portion and with a slope greater than that of the first portion, disposed upstream of said stopping means.

2. A device according to claim 1, in which said first portion with a slight slope follows the trajectory of the log leaving said winding area to avoid impacts and jolting without helping the acceleration thereof, whilst said second portion with a greater slope gives the log a high component of the gravity acceleration.

3. A device according to claim 1 characterized in that said first portion of the chute has a slope with respect to a horizontal plane falling within a range from 50° to 20°.

4. A device according to claim 1, characterized in that said second portion of the chute has a slope with respect to a horizontal plane falling within a range from 30° to 60°.

5. A device according to claim 1 characterized in that said chute comprises at least one third portion disposed downstream of said second portion and having a slope smaller than that of said second portion.

6. A device according to claim 5 characterized in that said third portion of the chute has a slope with respect to a horizontal plane falling within a range from 50° to 20°.

7. A device according to any one of the preceding claims, characterized in that said stopping means are disposed so as to stop or to slow said log at the end of said first portion of the chute and at the start of said second portion of the chute.

8. A device according to claim 1 characterized in that said stopping means comprise an arm disposed above said chute pivoted to the side of the rewinding machine.

9. A device according to claim 8, characterized in that when said arm is in the working position to stop or to slow the log a V-shaped narrowing having an angle of inclination greater than 30° is formed between the axis of said arm and said first portion of the chute.

10. A device according to claim 9, characterized in that said angle of inclination between the axis of said arm and said first portion of the chute is about 45°.

11. A device according to claim 8 characterized in that said arm rotates around its pivot by a fairly small angle between 10° to 20°, when it passes from the working position in which it stops or slows the log to the resting position in which it allows the log to roll freely on the chute.

12. A device according to claim 8 characterized in that shock absorbing means able to cushion the impact of said log are mounted on said arm.

13. A device according to claim 12, characterized in that said shock absorbing means comprise a curved rubber sheet or pad.

14. A device according to claim 8 characterized in that said drive means comprises a linear actuator acting on said arm.

15. A device according to claim 1 characterized in that said stopping means comprises a motorized roller.

16. A device according to claim 1 characterized in that said stopping means comprises a cam system.

17. A device according to claim 1 characterized in that at least one of said portions of the chute has a curved profile.

* * * * *